US005772060A

United States Patent [19]

Kaneko et al.

[11] Patent Number: 5,772,060

[45] Date of Patent: Jun. 30, 1998

[54] PULL-TAB FOR A LIQUID CONTAINER

[75] Inventors: Masamichi Kaneko, Tokyo; Hidetoshi Konno, Kanagawa; Junichi Satoyoshi, Tokyo, all of Japan

[73] Assignee: Tetra Laval Holdings & Finance S.A., Pully, Switzerland

[21] Appl. No.: 836,751

[22] PCT Filed: Nov. 29, 1995

[86] PCT No.: PCT/US95/15454

§ 371 Date: Jul. 25, 1997

§ 102(e) Date: Jul. 25, 1997

[87] PCT Pub. No.: WO96/16870

PCT Pub. Date: Jun. 6, 1996

[30] Foreign Application Priority Data

Nov. 29, 1994 [JP] Japan ..... 6-319046

[51] Int. Cl.[6] ..... B65D 5/72; B65D 17/50

[52] U.S. Cl. ..... 220/259; 220/269; 220/359; 220/711; 229/123.1; 156/227; 156/297

[58] Field of Search ..... 220/254, 256, 220/259, 269, 270, 359, 703, 711, 714, 715; 229/123.1; 383/66, 210, 211; 156/227, 297, 299

[56] References Cited

U.S. PATENT DOCUMENTS 4,258,876 3/1981 Ljungcrantz .

4,582,216 4/1986 Byrd .

FOREIGN PATENT DOCUMENTS 0 166 483 1/1986 European Pat. Off. .

*Primary Examiner*—Allan N. Shoap
*Assistant Examiner*—Nathan Newhouse
*Attorney, Agent, or Firm*—Burns, Doane, Swecker & Mathis, L.L.P.

[57] ABSTRACT

A pull-tab (10) for a pour opening in a surface of a lid is provided in the form of a sheet having a peripheral portion cut (17) into a ring shape with a connecting portion (15) remaining uncut so that a tab portion (20) and a body portion (30) are defined outside and inside the cut, respectively. The body portion (30) has an end portion remote from the connecting portion (15) and folded toward the back side thereof along a folding line (33) extending obliquely at an angle of 45 degrees with respect to a line connecting the end portion and the connecting portion. The pull-tab (10) is placed on the pour opening (83) and the lower side of the folded portion (31) is bonded to a surface of the upper lid (81) such that the pour opening (83) is covered with that portion of the body portion (30) located between the folded fixing part (31) and the connecting portion (15).

16 Claims, 3 Drawing Sheets

PULL-TAB FOR A LIQUID CONTAINER

BACKGROUND OF THE INVENTION

This invention relates to a pull-tab for a liquid container to be attached to a pour opening thereof.

Conventionally, a liquid container formed mainly of paper or a plastic is provided with a pour opening which is sealed with a lid member, such as a film-like sheet or a pull-tab made of a resin, attached thereto. The, container is opened by removing the whole lid member.

Once the whole lid member is removed, however, the pour opening is always in the opened state so that the liquid in the container, e.g., juice, is apt to be spilled. In addition, the removed lid member makes another piece of refuse which is separate from the liquid container and separately discarding the removed lid member increases problems of waste disposal.

To solve these problems, it is possible to construct the lid member such that only a part thereof is torn off. In this case, however, when the consumer releases the partly torn lid member, the lid member undesirably covers the pour opening again by its own restoring force (so-called toughness).

Further, with the construction in which only a part of the lid member is torn off, there arises another problem in that the lid member torn off and pulled up may interfere with the consumer's nose when the consumer drinks the contained liquid with the consumer's mouth being in direct contact with the pour opening.

The present invention has been made in view of the foregoing problems and is aimed at the provision of a pull-tab for a liquid container which is simple in structure and is easily producible, which retains the fully opened state without covering the pour opening even when the pull-tab after opening remains on the container and which does not act as an obstacle to drinking.

In accordance with one aspect of the present invention, a pull-tab for covering and sealing a pour opening of a liquid container is provided and includes a sheet having a ring-like cut therein. The cut has two ends separated by an uncut connecting portion and defines an outer tab portion and an inner body portion outside and inside the cut, respectively. The body portion has a folded end portion remote from the connecting portion and folded toward a back side of the sheet along a fold line extending obliquely relative to a line extending between a center of the end portion and a center of the connecting portion. A lower side of the folded end portion is bonded to a surface of the container such that the pour opening is covered and sealed with a sealing portion of the body portion located between the folded portion and the connecting portion.

In accordance with another aspect of the present invention, a container is provided and includes a top lid having a pour opening therein. The container further includes a pull-tab in the form of sheet having a rind-like cut therein. The cut has two ends separated by an uncut connecting portion and defines an outer tab portion and an inner body portion outside and inside the cut, respectively. The body portion has a folded end portion remote from the connecting portion and folded toward a back side of the sheet along a fold line extending obliquely relative to a line extending between a center of the end portion and a center of the connecting portion. A lower side of the folded end portion is bonded to a surface of the lid such that the pour opening is covered and sealed with a sealing portion of the body portion located between the folded portion and the connecting portion.

In accordance with still another aspect of the present invention, a method for making a container having a pull-tab is disclosed. According to the method, a ringlike cut is formed in a sheet. The cut has two ends separated by an uncut connecting portion and defines an outer tab portion and an inner body portion outside and inside the cut, respectively. An end portion of the body portion remote from the connecting portion is folded toward a back side of the sheet along a fold line extending obliquely relative to a line extending between a center of the end portion and a center of the connecting portion.

When the pull-tab is opened, the folded portion of the body portion is maintained in an expanded state so that the pull-tab does not move in such a direction as to close the pour opening (or the force acting on the pull-tab to move same in such a direction is small). Therefore, a sufficiently opened state can be easily maintained.

Further, since the end portion of the body portion opposite to the connecting portion is folded toward the back side thereof along a line extending obliquely relative to a line connecting the end portion and the connecting portion, the opened and retained pull-tab is oriented off to the side. Therefore, when the consumer drinks the contained liquid with the consumer's mouth being in direct touch with the pour opening, the pull-tab that has been pulled up and retained does not interfere with the consumer's nose.

BRIEF DESCRIPTION OF THE DRAWINGS

One embodiment of the present invention will be described in detail below with reference to the drawings wherein like reference numerals are used to designate similar elements and in which.

DETAILED DESCRIPTION

Figure 1A:
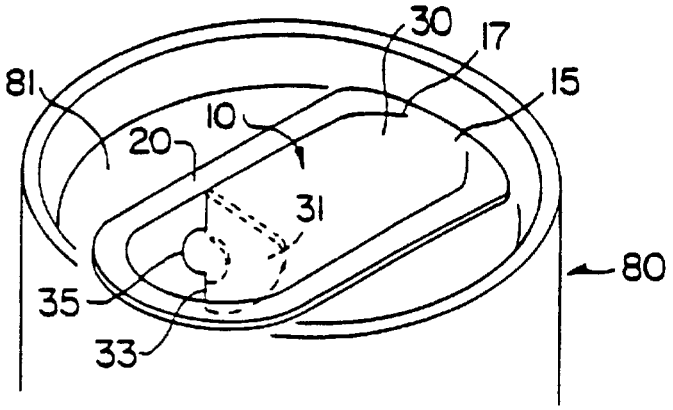
FIGS. 1A–1C are perspective, top, and side cross-sectional views of a pull-tab for a liquid container according to an embodiment of the present invention, the cross-sectional view of FIG. 1C being taken along the line 1C—1C of FIG. 1B.
Figure 1B:
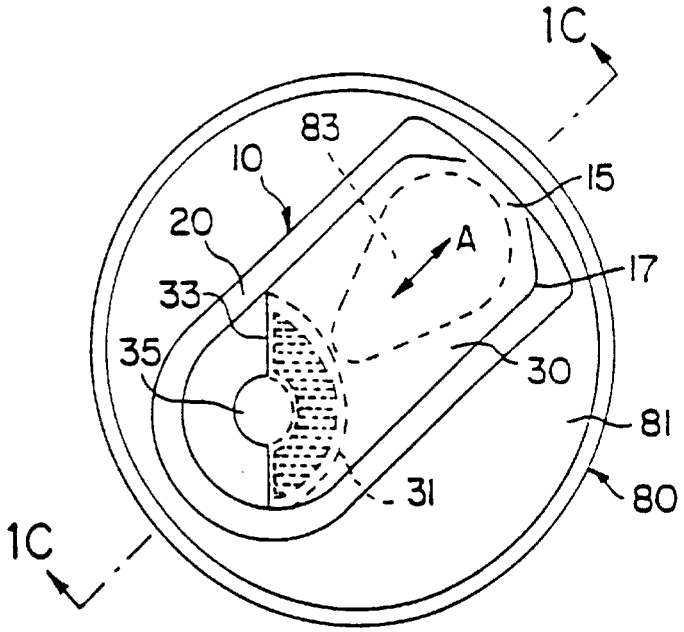
Figure 1C:
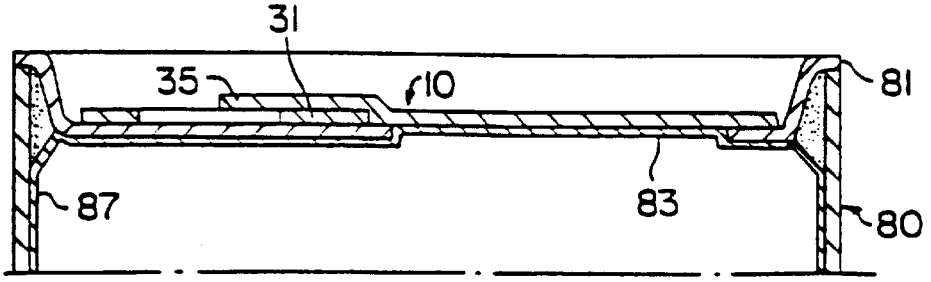

FIGS. 1A–1C show a pull-tab for a liquid container according to an embodiment of the present invention. As shown in these Figures, a pull-tab 10 is attached to an upper lid 81 of a liquid container 80 formed mainly of paper or a plastic material for covering and sealing a pour opening 83 provided in the upper lid.

The pull-tab 10 is formed of a resin sheet having an approximately elliptic external shape and a peripheral portion cut into a ring-like shape along a cut line 17 with a connecting portion 15 remaining uncut so that a tab portion 20 and a body portion 30 are defined outside and inside the cut line, respectively.

The body portion 30 has an end portion remote from the connecting portion 15 and folded toward the back side thereof along a folding line 33 extending obliquely at an angle of about 45 degrees with respect to a line extending in a longitudinal direction of the pull-tab 10 and between the end portion and the connecting portion 15. The folded portion serves to function as a fixing part 32 (shown by the dotted line).

In other words, the folding line 33 is formed as a line extending obliquely at an angle of about 45 degrees with respect to the direction the direction of the line A in FIG. 1B along which the pour opening 83 is inclined when the consumer drinks the contained liquid with the consumer's mouth being in touch therewith.

An arcuate, protruded retaining piece 35 is provided at the center of the folding line 33.

Figure 4:
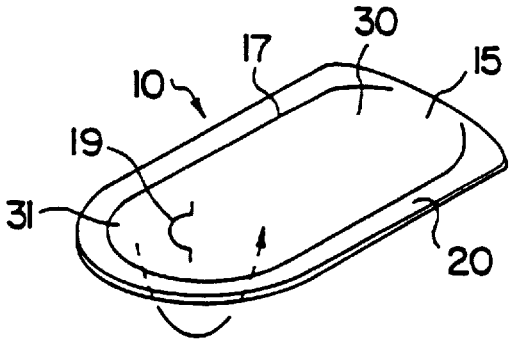
FIG. 4 is a perspective view of a pull-tab according to an embodiment of the present invention, showing steps according to a method of preparing the pull-tab according to an embodiment of the present invention.

The pull-tab 10 is prepared and is attached to the liquid container 80 as follows. As shown in FIG. 4, the external shape of the pull-tab 10 is punched from a sheet and the cut lines 17 and 19 are formed. Then, the fixing part 31 is folded toward the back side of the body portion 30 (in the direction of the arrow in FIG. 4) with the folding line 33 connecting both ends of the cut line 19 (FIGS. 1A–1B).

The resulting pull-tab 10 is placed, as shown in FIGS. 1A–1C, on the upper lid 81 of the liquid container 80. The lower side of the fixing part 31 of the pull-tab 10 is secured by bonding or welding to the upper lid 81 such that the pour opening 83 is covered with that portion of the body portion 30 located between the folded fixing part 31 and the connecting portion 15. The surface to be secured is shown by the dotted slant lines in FIG. 1B.

As shown in FIG. 1C, a thin resin film 87 is applied, for the sealing of the pour opening 83, to the inside surface of the liquid container 80 and that part of the lower side of the pull-tab positioned in the pour opening 83. Thus, the operation for attaching the pull-tab 10 is completed.

Figure 2A:
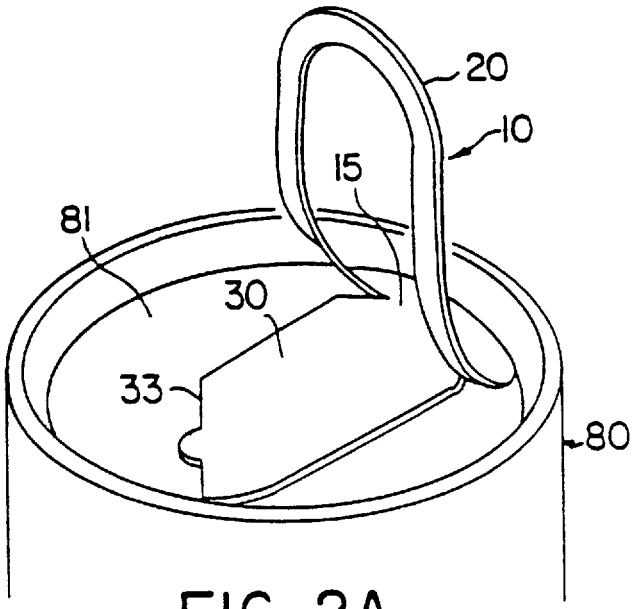
FIGS. 2A–2C are perspective views showing operation of the pull-tab for liquid container according to an embodiment of the present invention.
Figure 2B:
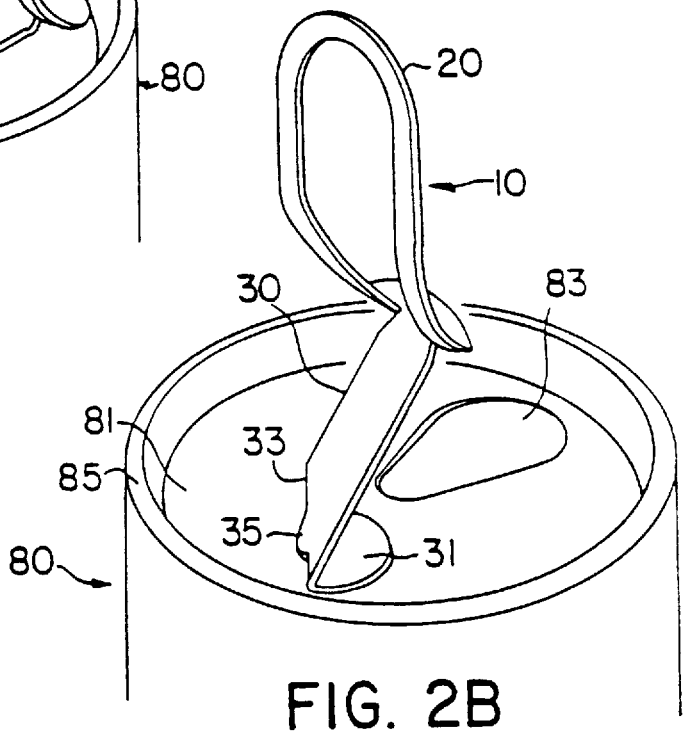
Figure 2C:
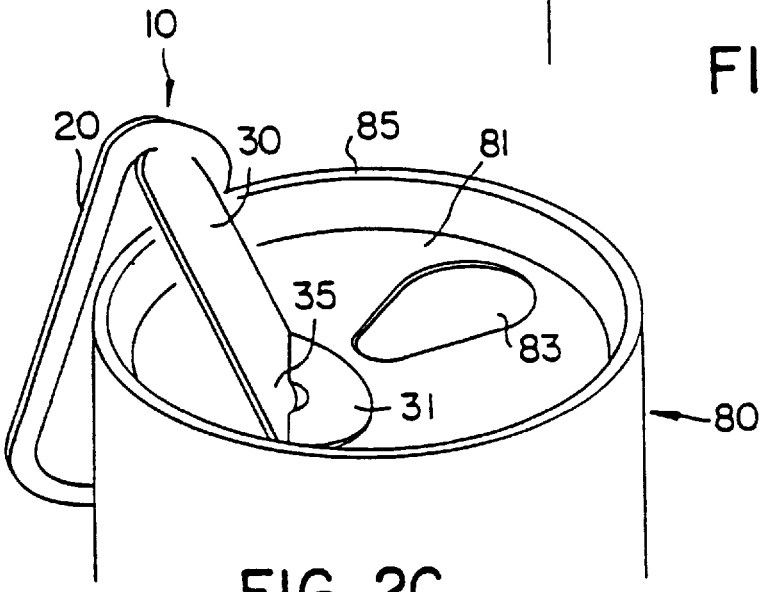

Next, FIGS. 2A through 2C show the operation for opening the pull-tab 10. Thus, as shown in FIG. 2A, the tab portion 20 of the pull-tab 10 is pulled up about the connecting portion 15.

When the tab 20 is further pulled up, as shown in FIG. 2B, the body portion 30 is pulled up from the upper lid 81 about a portion near the folding line 33 of the fixing part 31. At this time, the film 87 (FIG. 1C) applied to the lower side of the body portion 30 is torn off in conformity with the shape of the pour opening 83, thereby to open the pour opening 83.

From this state, the tab 20 is further pulled up and drawn toward the flange 85 on the periphery of the upper lid 81 and, then, is brought into engagement with the flange 85 as shown in FIG. 2C. In this case, the tip end of the retaining piece 35 is rotated above the upper lid 81 and positioned on the fixing part 31 side for abutting engagement with the upper lid 81.

In the present invention, when the pull-tab 10 is opened as shown in FIG. 2C, the folded part of the body portion 30 keeps the expanded state so that the pull-tab 10 does not move in such a direction as to close the pour opening 83 (or the force acting on the pull-tab to move same in such a direction is small). Therefore, a sufficiently opened state can be easily maintained and the pour opening 83 is not again covered with the pull-tab.

Further, since the present embodiment uses the retaining piece 35 provided adjacent the folding line 33 and since the retaining piece 35 is, as described above, positioned on the fixing part 31 side for abutting engagement with the upper lid 81 when the pull tab 10 is pulled up, the sufficiently opened state of the pull-tab 10 can be maintained even more reliably.

Figure 3:
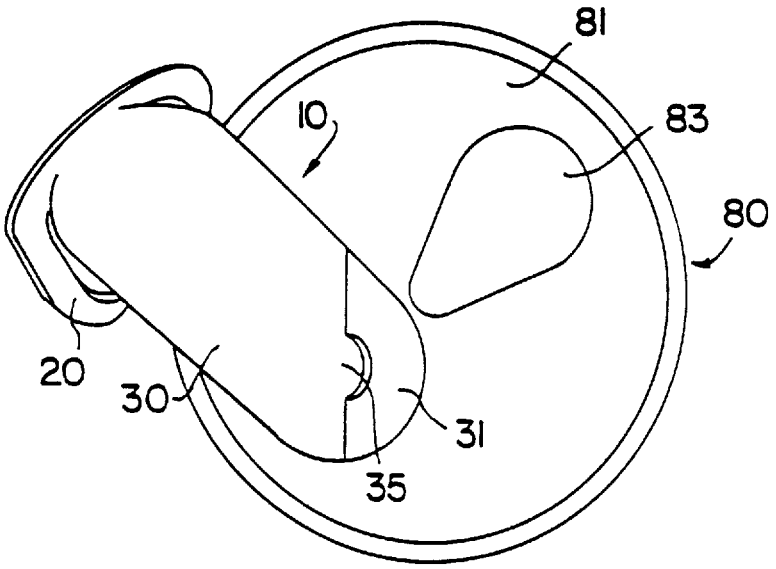
FIG. 3 is a top plan view showing a pull-tab according to an embodiment of the present invention in an opened and retained state.

The body portion 30 is pulled up about a portion near the folding line 33. In this case, since the folding line extends obliquely at an angle of about 45 degrees relative to the longitudinal direction of the pull-tab 10, the body portion 30 pulled up is retained in a state where it faces in a lateral direction about 90 degrees different from the longitudinal direction of the pull-tab 10 in the initial state as shown in FIG. 2C and FIG. 3.

Therefore, when the consumer drinks the contained liquid with the consumer's mouth being in direct touch with the pour opening 83, the pull-tab that has been pulled up and retained does not interfere with the consumer's nose.

As described in detail in the foregoing, the pull-tab for a liquid container according to the present invention has the following excellent effects.

(1) A sufficiently opened state can be maintained even when the pull-tab, after the opening, is kept attached to the liquid container. Thus, tho pour opening 83 is not again covered with the pull-tab.

(2) The pull-tab does not make a refuse separate from the liquid container.

(3) Since, in drinking, the pull-tab in the opened state is oriented off to the side from the pour opening 83, there is no fear of the pull-tab interfering with the consumer's nose.

(4) It is easy to prepare the pull-tab, since the pull-tab can be produced by merely cutting from a sheet.

If desired or necessary, the structure in which the pour opening 83 is sealed with the pull-tab 10 is not limited only to the above-described structure and various other sealing structures may be adopted. Also, the inclination angle of the folding line 33 may be any other angle than about 45 degrees.

While this invention has been illustrated and described in accordance with a preferred embodiment, it is recognized that variations and changes may be made therein without departing from the invention as set forth in the claims.

What is claimed is:

1. A pull-tab for covering and sealing a pour opening of a liquid container, comprising:

a sheet having a ring-like cut therein, the cut having two ends separated by an uncut connecting portion and defining an outer tab portion and an inner body portion outside and inside the cut, respectively, the body portion having a folded end portion remote from the connecting portion and folded toward a back side of the sheet along a fold line extending obliquely relative to a line extending between a center of the end portion and a center of the connecting portion, wherein a lower side of the folded end portion is bonded to a surface of the container such that the pour opening is covered and sealed with a sealing portion of the body portion located between the folded portion and the connecting portion.

2. The pull-tab as set forth in claim 1, wherein the cut is substantially U-shaped.

3. The pull-tab as set forth in claim 2, wherein legs of the U-shaped cut extend in a direction of the line extending between the center of the end portion and the center of the connecting portion.

4. The pull-tab as set forth in claim 3, wherein the fold line extends at a 45° angle to the line extending between the center of the end portion and the center of the connecting portion.

5. The pull-tab as set forth in claim 1, wherein the fold line extends at a 45° angle to the line extending between the center of the end portion and the center of the connecting portion.

6. A container, comprising:

a top lid having a pour opening therein;

a pull-tab in the form of sheet having a ring-like cut therein, the cut having two ends separated by an uncut connecting portion and defining an outer tab portion and an inner body portion outside and inside the cut, respectively, the body portion having a folded end portion remote from the connecting portion and folded toward a back side of the sheet along a fold line extending obliquely relative to a line extending between a center of the end portion and a center of the connecting portion, wherein a lower side of the folded end portion is bonded to a surface of the lid such that the pour opening is covered and sealed with a sealing portion of the body portion located between the folded portion and the connecting portion.

7. The container as set forth in claim 6, wherein the cut is substantially U-shaped.

8. The container as set forth in claim 7, wherein legs of the U-shaped cut extend in a direction of the line extending between the center of the end portion and the center of the connecting portion.

9. The container as set forth in claim 8, wherein the fold line extends at a 45° angle to the line extending between the center of the end portion and the center of the connecting portion.

10. The container as set forth in claim 6, wherein the fold line extends at a 45° angle to the line extending between the center of the end portion and the center of the connecting portion.

11. The container as set forth in claim 6, further comprising a resin film applied to an inside surface of the container, the sealing portion being sealed to the resin film.

12. The container as set forth in claim 6, wherein the pour opening is longer in a longitudinal direction than in a transverse direction, the fold line extending at a 45° angle to the longitudinal direction.

13. A method for making a container having a pull-tab, comprising the steps of:

forming a ring-like cut in a sheet, the cut having two ends separated by an uncut connecting portion and defining an outer tab portion and an inner body portion outside and inside the cut, respectively; and folding an end portion of the body portion remote from the connecting portion toward a back side of the sheet along a fold line extending obliquely relative to a line extending between a center of the end portion and a center of the connecting portion.

14. The method as set forth in claim 13, comprising the further step of applying a resin film to an inside surface of a liquid container so that the resin film covers a pour opening of the container.

15. The method as set forth in claim 14, comprising the further step of attaching the end portion of the sheet to the container and attaching a sealing portion of the body portion located between the folded portion and the connecting portion over the pour opening and to the resin film.

16. The method as set forth in claim 13, comprising the further step of attaching the end portion of the sheet to the container and attaching a sealing portion of the body portion located between the folded portion and the connecting portion over the pour opening.

* * * * *